US007896680B2

(12) United States Patent
Szu

(10) Patent No.: US 7,896,680 B2
(45) Date of Patent: Mar. 1, 2011

(54) ZERO INSERTION FORCE SOCKET CONNECTOR PREVENTING PIN LEGS OF CPU FROM OVER MOVEMENT

(75) Inventor: Ming-Lun Szu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/613,559

(22) Filed: Nov. 6, 2009

(65) Prior Publication Data

US 2010/0120293 A1 May 13, 2010

(30) Foreign Application Priority Data

Nov. 10, 2008 (CN) ..... 09 7 22013

(51) Int. Cl.
*H01R 4/50* (2006.01)
*H01R 13/625* (2006.01)

(52) U.S. Cl. ..... 439/342; 439/71

(58) Field of Classification Search ..... 439/342, 439/71, 857, 343
See application file for complete search history.

(56) References Cited

U.S. PATENT DOCUMENTS 6,554,634 B1 4/2003 Lin et al.
6,638,119 B1 * 10/2003 Chang ..... 439/857
6,773,290 B2 * 8/2004 Lai ..... 439/342
7,175,462 B2 * 2/2007 Hashimoto ..... 439/342
7,182,607 B2 * 2/2007 Huang et al. ..... 439/71
7,322,829 B2 * 1/2008 Ma ..... 439/66
7,361,044 B1 * 4/2008 Pandey et al. ..... 439/342
7,371,075 B2 * 5/2008 Liao et al. ..... 439/71
7,377,792 B2 * 5/2008 Ma ..... 439/71
7,601,036 B2 * 10/2009 Cheng et al. ..... 439/857
2007/0004244 A1 1/2007 Ma
2008/0227324 A1 * 9/2008 Cheng et al. ..... 439/342
2009/0215291 A1 * 8/2009 Taguchi et al. ..... 439/83

FOREIGN PATENT DOCUMENTS

TW M323701 12/2007

* cited by examiner

*Primary Examiner*—Hae Moon Hyeon
(74) *Attorney, Agent, or Firm*—Andrew C. Cheng; Wei Te Chung; Ming Chieh Chang

(57) ABSTRACT

A socket connector includes an insulative housing (13), a number of contacts (12) received in the insulative housing and a cover (10) moveable with respect to the insulative housing. The cover has a mating surface (104) facing the insulative housing, a coupling surface (103) opposite to the mating surface, rows of slots (102) extending through the mating surface and the coupling surface, and at least one block (101) on the mating surface. The at least one block is located between two adjacent slots.

17 Claims, 5 Drawing Sheets

ZERO INSERTION FORCE SOCKET CONNECTOR PREVENTING PIN LEGS OF CPU FROM OVER MOVEMENT

BACKGROUND OF THE INVENTION

1. Field of the Invention

The present invention relates generally to a socket connector, and more particularly to a zero insertion force (ZIF) socket connector preventing pin legs of the CPU from over movement.

2. Description of Related Arts

U.S. Pat. No. 6,554,634 issued to Lin et al. on Apr. 29, 2003 discloses an electrical connector having an insulative housing and an electrical contact received in the insulative housing, connecting a pin leg of a CPU (central processing unit) onto a PCB (printed circuit board). The electrical contact has a base portion, a solder portion extending from the base portion, and a pair of spaced arms. Each arm has a body section extending from the base portion and a finger including a lead-in section extending from the body section and a contact section extending from the lead-in section. The lead-in sections of the fingers are coined to define planar lead-in surfaces for guiding the pin leg of the CPU into the contact sections with zero insertion force (ZIF). However, the contact sections define an opening slot to the air and there are no stopping feature formed on the insulative housing for the pin leg, which causes the pin leg of the CPU easily over movement beyond the contact section. The electrical connection between the CPU and the PCB is destroyed.

Hence, a socket connector preventing pin legs of the CPU from over movement is desired.

SUMMARY OF THE INVENTION

Accordingly, an object of the present invention is to provide a socket connector preventing pin legs of the CPU from over movement.

To achieve the above object, a socket connector includes an insulative housing, a plurality of contacts received in the insulative housing and a cover moveable with respect to the insulative housing. The cover has a mating surface facing the insulative housing, a coupling surface opposite to the mating surface, rows of slots extending through the mating surface and the coupling surface, and at least one block on the mating surface. The at least one block is located between two adjacent slots.

Other objects, advantages and novel features of the invention will become more apparent from the following detailed description when taken in conjunction with the accompanying drawings.

DETAILED DESCRIPTION OF THE PREFERRED EMBODIMENT

Figure 1:
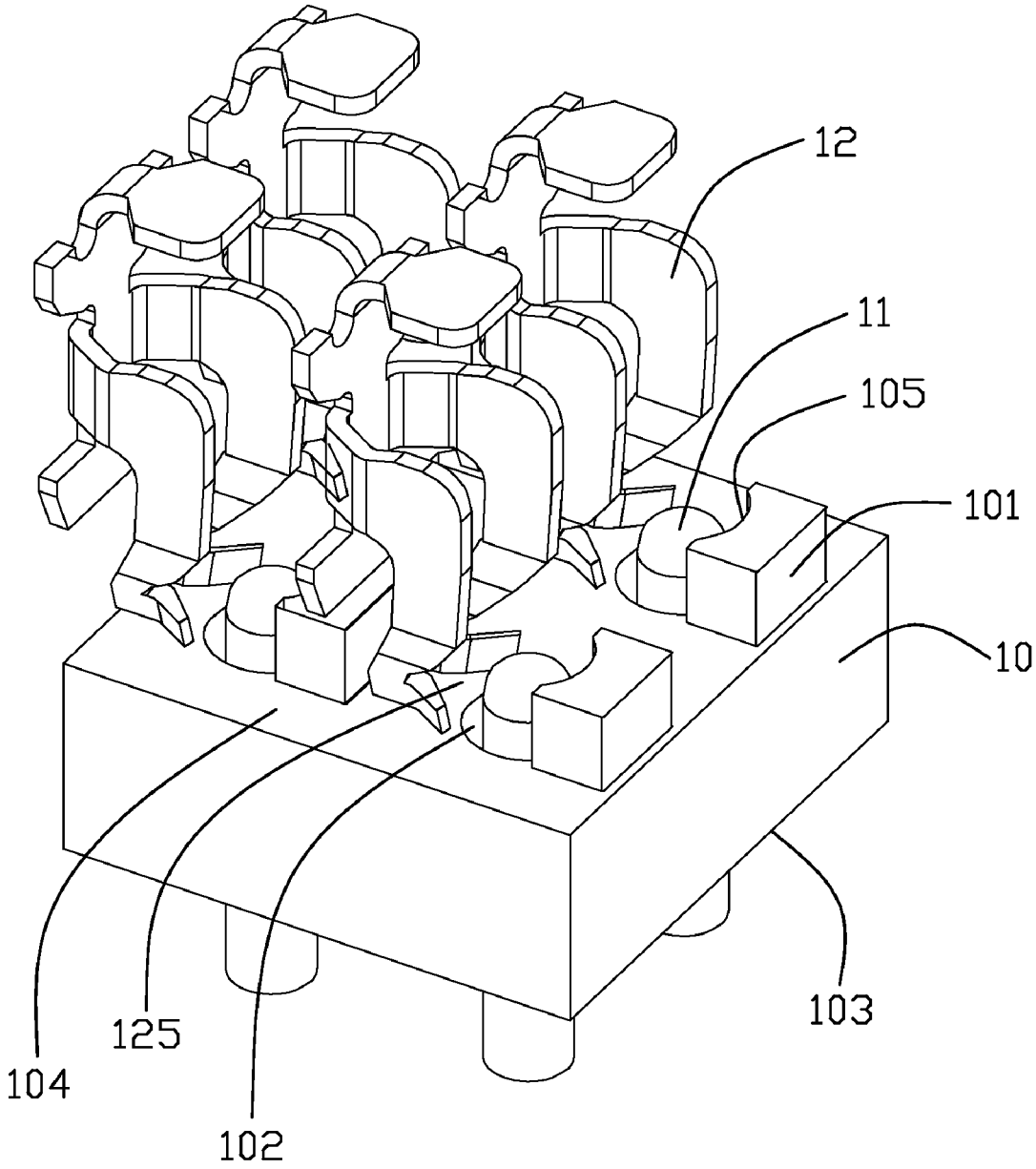
FIG. 1 is a perspective, partly view of a socket connector constructed in accordance with the present invention only showing a plurality of contacts and a cover forming a plurality of blocks, and a plurality of pin legs of the CPU is included therein.
Figure 2:
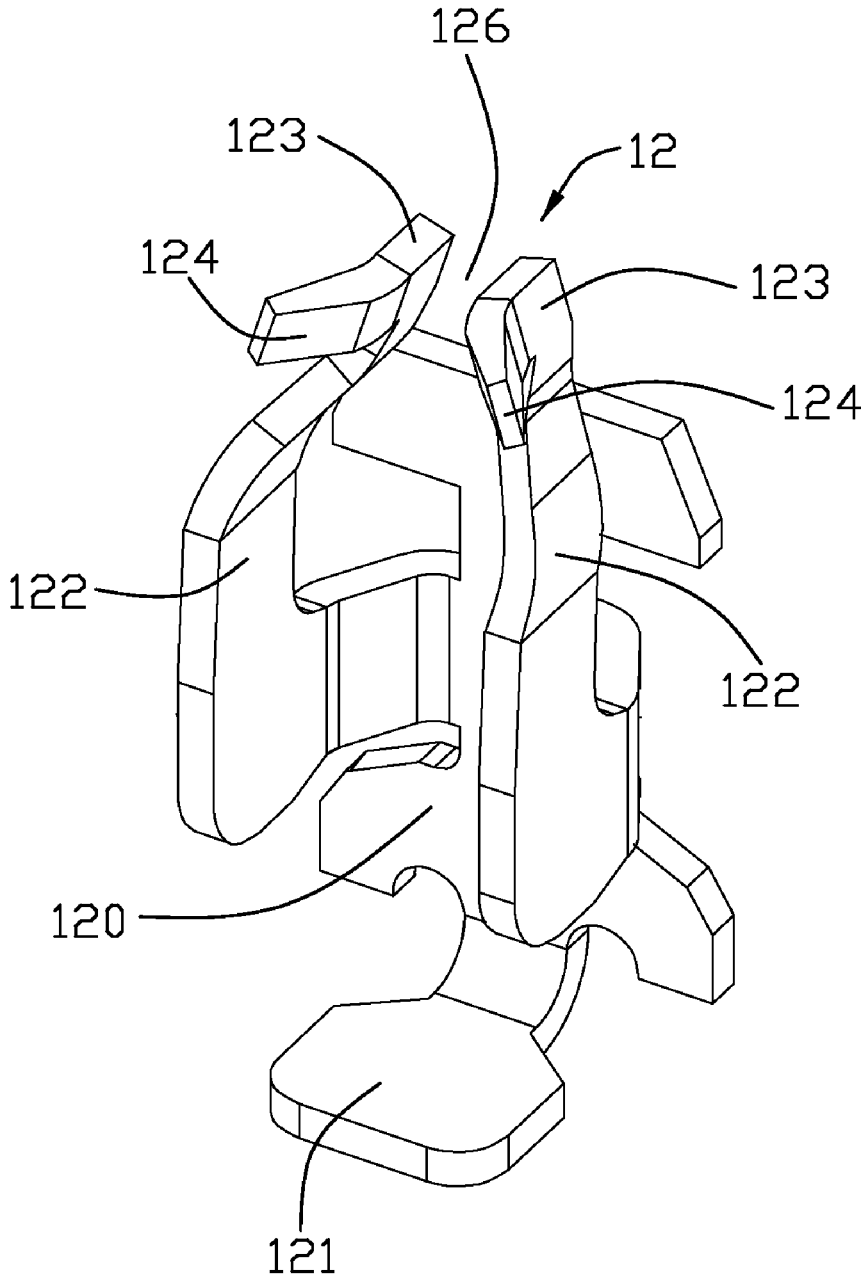
FIG. 2 is a perspective view of the contact of FIG. 1.
Figure 3:
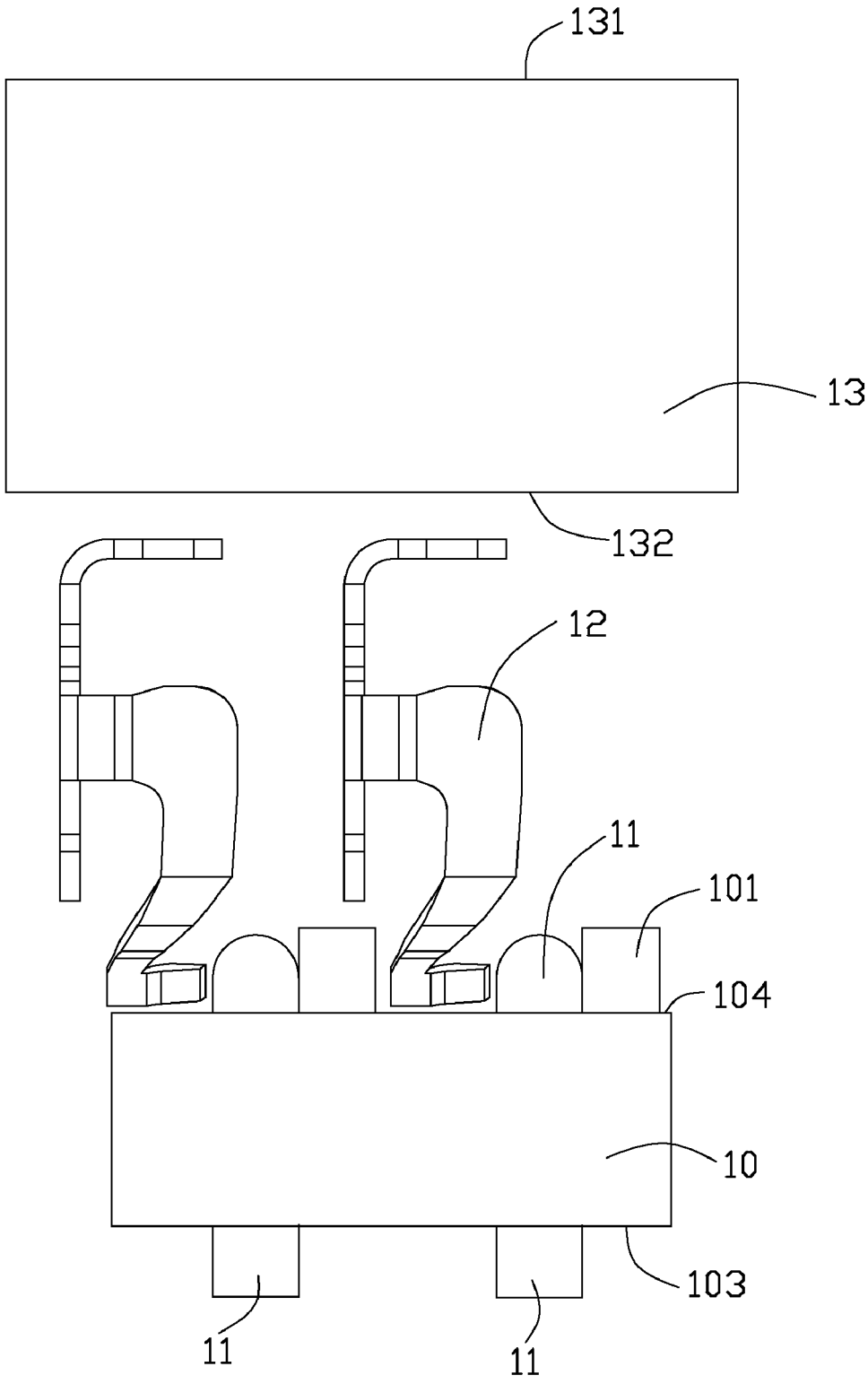
FIG. 3 is a perspective, side view of the socket connector with the insulative housing of the connector and the inserted pin legs shown therein.

Referring to FIGS. 1-3, a socket connector (not labeled) of the present invention, used for connecting with a plurality of pin legs 11 of a CPU (not shown) and a printed circuit board (PCB, not shown), includes an insulative housing 13, a plurality of contacts 12 received in the insulative housing 13, and a cover 10 horizontally moveable with respect to the insulative housing 13 and urging electrical connection between the pin legs 11 and the contacts 12.

Referring to FIGS. 1-2, the contact 12 comprises a base portion 120, a soldering portion 121 extending downwardly, vertically from the base portion 120, a pair of spaced arms 122 extending from opposite lateral edges of the base portion 120, a pair of engaging portions 123 formed on the spaced arms 122, and a pair of lead-in portions 124 extending from the engaging portions 123. The lead-in portions 124 define a first interspace 125 and the engaging portions 123 define a second interspace 126 communicating with the first interspace 125. Furthermore, the first interspace is larger than the second interspace for facilitating insertion of the pin legs of the CPU into the lead-in portions 124 with zero insertion force. The base portion 120 of the contact 12 is essentially a vertical retaining section retained in the insulative housing 13.

Figure 4:
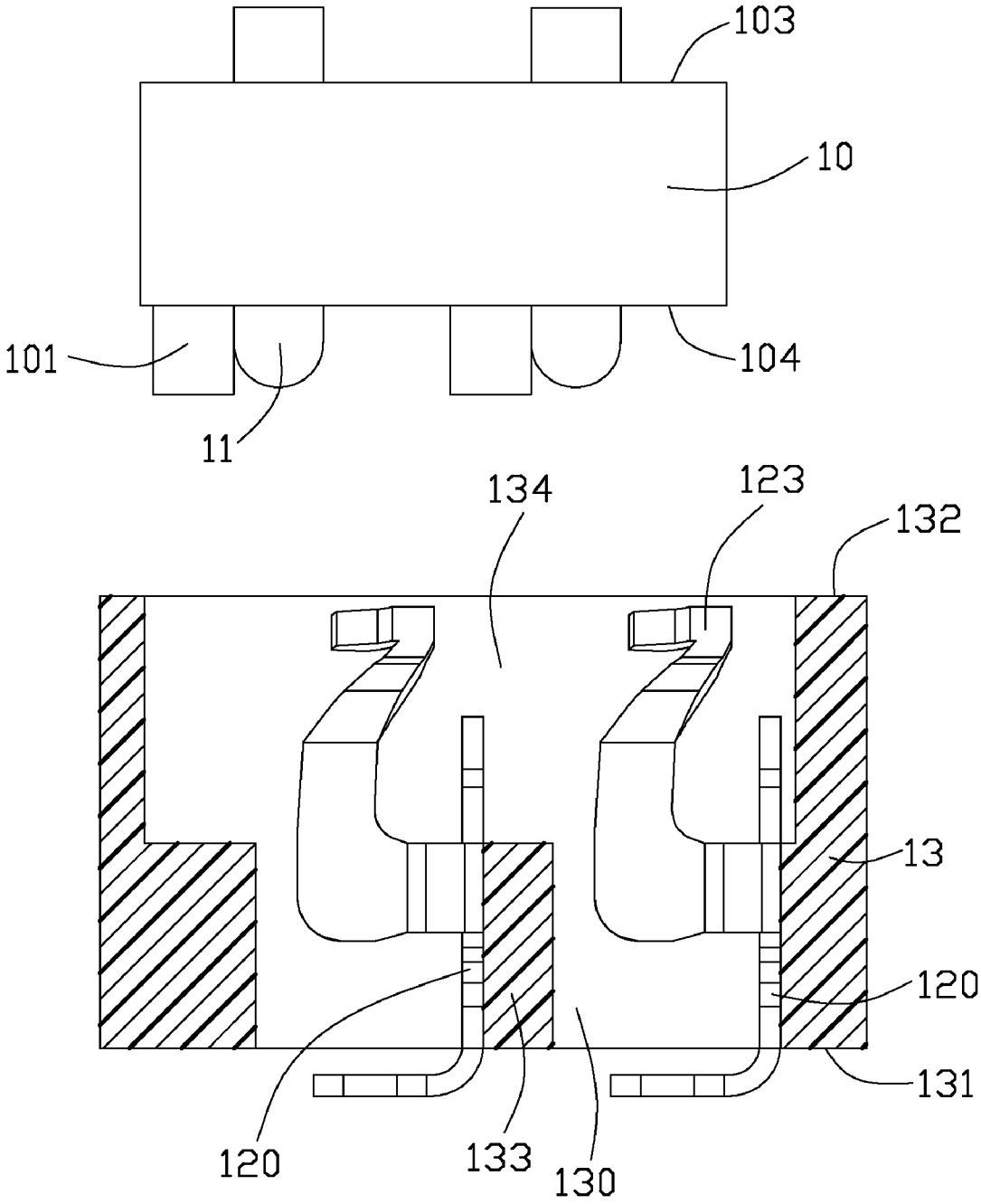
FIG. 4 is a cross-sectional view of the socket connector before the pin legs associated with the cover are assembled to the insulative housing with the terminals retained therein.
Figure 5:
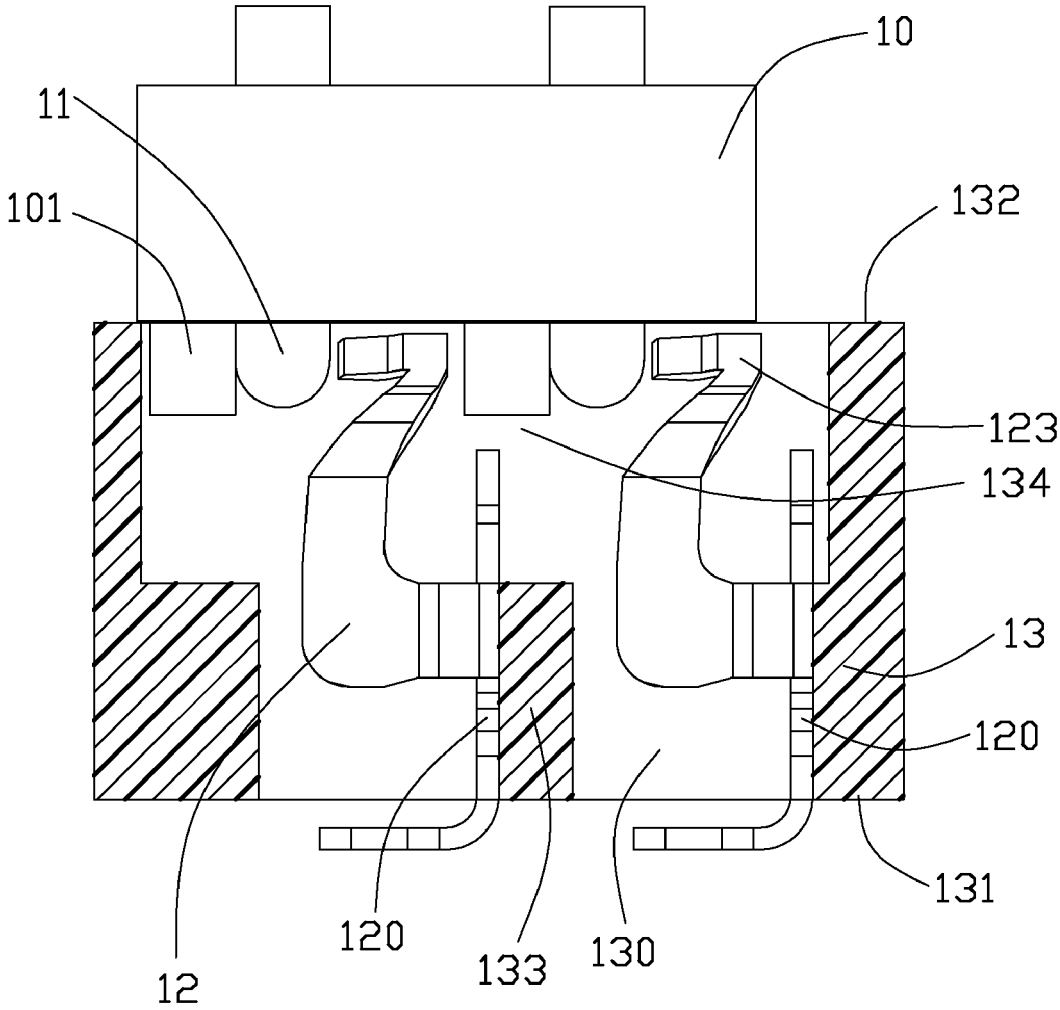
FIG. 5 is a cross-sectional view of the socket connector after the cover is assembled to the insulative housing.

Referring to FIGS. 3 and 4, the insulative housing 13 defines a connecting surface 132 facing towards the cover 10, a soldering surface 131 opposite to the connecting surface 132, and a plurality of passageways 130 extending through the soldering surface 131 and the connecting surface 132. Each passageway 130 is formed and surrounded by corresponding dividing walls 133. Certain of the dividing walls 133 has a corresponding notch 134 at a top portion thereof. The contacts 12 are received in the passageways 130 of the insulative housing 13 with the contacting portions 123 and the lead-in portions 124 at the top portion of the passageway 130, i.e., extending lower than the connecting surface 132 of the insulative housing 13 for connecting with the pin legs 11 of the CPU.

Referring to FIGS. 1-5, the cover 10 defines a mating surface 104 facing toward the insulative housing 13 and a coupling surface 103 opposite to the mating surface 104 to support the CPU. The cover 10 defines a plurality of slots 102 connecting the mating surface 104 with the coupling surface 103, and forms a plurality of blocks 101 on the mating surface 104, each beside a same edge of the slot 102. The block 101 defines an arcuate portion 105 facing the slot 102. The pin legs 11 of the CPU extend through the slots 102 of the cover 10 and are moveable accompanying with the cover 10. Some blocks 101 are partly received in adjacent passageways 130 when the cover 10 is assembled to the insulative housing 13 under an initial open position. The contacting portion 123 of the contact 12 and the notch 134 are essentially located at a same level. Especially, the pin leg 11 is located between the corresponding block 101 and the corresponding contacting portion 123 in a mating, lengthwise direction perpendicular to a vertical direction. The cover 10 moves subsequently along the mating direction with respect to the insulative housing 13 to be at a closed mating position. Thereafter, the pin legs 11 of the CPU move into the second interspace 126 from the first interspace 125 and are sandwiched between the engaging portions 123. The blocks 101 are capable of moving from the adjacent passageways 130 into the corresponding passageways 130 of the insulative housing 13 through the notch 134 during the movement of the cover 10 with respect to the insulative housing 13 along the lengthwise direction. Because each block 101 has a transverse width larger than the first interspace 125 of the lead-in portions 124, the blocks 101 confront with the lead-in portions 124 of the contacts 12 in case the cover 10 is over-pushed. Therefore, the pin legs 11 of the CPU are prevented from moving away from the engaging portions 123. In an alternative embodiment, the number of the blocks 101 is not same as that of the slots 102, but at least one block 101 is provided for two adjacent slots 102.

In the present invention, because each contact 12 and the corresponding block 101 are located at two opposite sides of the pin leg 11, the block 101 confronts with the lead-in portions 124 of the contact 12 in case the cover 10 is over-pushed so as to prevent the pin leg 11 from moving away from the engaging portions 123.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A socket connector, comprising:

an insulative housing defining a connecting surface and a soldering surface opposite to the connecting surface, the insulative housing having a plurality of passageways extending through the soldering surface and the connecting surface;

a plurality of contacts received in the passageways of the insulative housing; and a cover moveable with respect to the insulative housing, the cover having a mating surface facing the insulative housing, a coupling surface opposite to the mating surface, rows of slots extending through the mating surface and the coupling surface, and at least one block on the mating surface;

wherein the at least one block is located between two adjacent slots and the at least one block is partly received in an adjacent passageway during downward movement of the cover with respect to the insulative housing.

2. The socket connector as described in claim 1, wherein the contact comprises a base portion, a pair of spaced arms extending from opposite lateral edges of the base portion, a pair of engaging portions formed on the spaced arms, and a pair of lead-in portions extending from the engaging portions.

3. The socket connector as described in claim 2, wherein the lead-in portions define a first interspace opening to a corresponding slot.

4. The socket connector as described in claim 3, wherein the block defines an arcuate portion facing the slot.

5. The socket connector as described in claim 3, wherein the engaging portions define a second interspace communicating with the first interspace.

6. The socket connector as described in claim 5, wherein the first interspace is larger than the second interspace.

7. The socket connector as described in claim 1, wherein the at least one block is moveable to a corresponding passageway during horizontal movement between the cover and the insulative housing.

8. A socket connector assembly comprising:

an insulative housing defining a plurality of dividing walls and a plurality of passageways extending in a vertical direction, each passageway being formed and surrounded by corresponding dividing walls;

a plurality of contacts respectively disposed in corresponding passageways;

a cover mounted upon the housing and moveable back and forth along a lengthwise direction;

a plurality of blocks downwardly protruding from a bottom surface of the cover into corresponding passageways of the housing; and some of dividing walls each having a corresponding notch at a top portion, and the corresponding block passes said notch when said corresponding block is back and forth moved along said lengthwise direction.

9. The socket connector assembly as claimed in claim 8, wherein each of said contacts includes a contacting section at a top region, and said notch is essentially located at a same level with the contacting section.

10. The socket connector assembly as claimed in claim 8, wherein said cover defines a plurality of through slots each essentially aligned with the corresponding passageway and the corresponding contact disposed in said corresponding passageway, and each of said blocks is associatively located beside the corresponding one of said slots.

11. The socket connector assembly as claimed in claim 10, further including an electronic package mounted upon the cover and having pin legs respectively extending through the corresponding slots for mechanical and electrical engagement with the corresponding contacts.

12. The socket connector assembly as claimed in claim 11, wherein said pin legs are further laterally leaning against the corresponding blocks, respectively.

13. The socket connector assembly as claimed in claim 11, wherein each of said pin leg is located between the corresponding block and the corresponding contacting section in said lengthwise direction.

14. The socket connector assembly as claimed in claim 10, wherein each of said contacts which is essentially aligned with the corresponding slot, defines a vertical retaining section for retaining to the housing, and the block which is associated with another slot neighboring said corresponding slot in said lengthwise direction, is located above and essentially aligned with said retaining section when said cover is located in an initial position for zero insertion of an electronic package into the housing.

15. The socket connector assembly as claimed in claim 14, wherein the block, which is located above and essentially aligned with the retaining section of the neighboring contact when the cover is located in the initial position, is received in the notch of the dividing wall of the corresponding passageway in which the corresponding contact is located when the cover is moved to a final position for mating with the electronic package.

16. A socket connector assembly comprising:

an insulative housing defining a plurality of passageways extending in a vertical direction;

a plurality of contacts respectively disposed in the corresponding passageways, each of said contacts having corresponding contacting section at a top region;

a cover defining a plurality of slots in alignment with the corresponding passageways, respectively, and mounted upon the housing and moveable back and forth along a lengthwise direction;

a plurality of blocks downwardly protruding from a bottom surface of the cover into corresponding passageways of the housing; and an electronic package mounted upon the cover with pin legs downwardly extending through the corresponding slots and into the corresponding passageways, respectively, each of said pin legs defining a mating end section; wherein the block, the mating end section of the corresponding pin leg, and the contacting section of the corresponding contact are essentially located at a same level under condition that the block and the corresponding contacting section are located by two sides of the corresponding pin leg in said lengthwise direction.

17. The socket connector assembly as claimed in claim 16, wherein the block is close to the contacting section of the neighboring contact in said lengthwise direction when said cover is located in an initial position for zero insertion of an electronic package into the housing, while is close to the contacting section of the corresponding contact in said lengthwise direction when the cover is moved to a final position for mating with the electronic package.

* * * * *